US009350085B2

(12) United States Patent
Ridel et al.

(10) Patent No.: US 9,350,085 B2
(45) Date of Patent: May 24, 2016

(54) PHASED ARRAY FEEDER (PAF) FOR POINT TO POINT LINKS

(75) Inventors: Eran Ridel, Rosh Ha'aiyn (IL); Igal Kushnir, Azur (IL)

(73) Assignee: Broadcom Corporation, Irvine, CA (US)

( * ) Notice: Subject to any disclaimer, the term of this patent is extended or adjusted under 35 U.S.C. 154(b) by 1053 days.

(21) Appl. No.: 13/435,604

(22) Filed: Mar. 30, 2012

(65) Prior Publication Data

US 2013/0162493 A1 Jun. 27, 2013

Related U.S. Application Data

(60) Provisional application No. 61/579,401, filed on Dec. 22, 2011, provisional application No. 61/565,469, filed on Nov. 30, 2011.

(51) Int. Cl.

| | |
|---|---|
| ***H01Q 3/26*** | (2006.01) |
| ***H01Q 19/17*** | (2006.01) |
| ***H01Q 3/00*** | (2006.01) |

(52) U.S. Cl.

CPC ..... *H01Q 19/17* (2013.01); *H01Q 3/005* (2013.01); *H01Q 3/26* (2013.01)

(58) Field of Classification Search

CPC ..... H01Q 3/005; H01Q 3/26; H01Q 19/10; H01Q 19/17; H04M 1/00

USPC ..... 343/834; 455/562.1, 25, 456

See application file for complete search history.

(56) References Cited

U.S. PATENT DOCUMENTS

| | | | | |
|---|---|---|---|---|
| 7,027,837 B1 * | 4/2006 | Uhlik | ..... | H01Q 21/29 375/347 |
| 7,065,326 B2 * | 6/2006 | Lovberg | ..... | H01Q 1/125 332/141 |

* cited by examiner

*Primary Examiner* — Hoang V Nguyen

(74) *Attorney, Agent, or Firm* — Sterne, Kessler, Goldstein & Fox P.L.L.C.

(57) ABSTRACT

A point-to-point (PtP) communication system includes a near end antenna device configured to transmit a narrow antenna beam over a wireless link, and includes a far end antenna device configured receive the narrow antenna beam over the wireless link. The near end antenna device including a directive element configured to focus an electrical field into the narrow antenna beam, and including a beam steering element (e.g., a phased array feeder (PAF) assembly) configured to generate the electrical field and to track the far end antenna, and further including a communication interface unit (e.g., an outdoor unit) configured to perform operations on a transmitted signal and a received signal.

24 Claims, 5 Drawing Sheets

PHASED ARRAY FEEDER (PAF) FOR POINT TO POINT LINKS

CROSS REFERENCE TO RELATED APPLICATIONS

This patent application claims the benefit of U.S. Provisional Patent Application No. 61/565, 469, filed Nov. 30, 2011. This patent application also claims the benefit of U.S. Provisional Patent Application No. 61/579, 401, filed Dec. 22, 2011, which is incorporated herein by reference in its entirety.

BACKGROUND OF THE INVENTION

1. Field of the Invention

The invention generally relates to point-to-point communication links, and more specifically to an antenna having a phased array feeder (PAF).

2. Related Art

Conventional point-to-point (PtP) communication links generally establish a wireless communication link between multiples antennas. The antennas generally include at least a dish reflector, a horn and an outdoor unit.

The outdoor unit typically performs both necessary intermediate frequency (IF) conversions as well as radio frequency (RF) conversions. Therefore, these conventional outdoor units are relatively large in size, and are generally quite complicated to implement within these conventional antennas. Additionally, there is a lack of low cost components in the current marketplace that can perform the necessary RF conversions. Consequently, in addition to their complexity, typical outdoor units are also very expensive.

Typically, the horn is commonly used as a passive element within these conventional antennas. Conventional horns are also configured to direct radiation that is being emitted from the dish reflector. Conventional horns are characterized by a direction of maximum radiation that generally corresponds with the axis of the horn, which is typically chosen during installation of the antenna. Therefore, a direction of a transmission signal emitted from a conventional antenna is generally static, meaning that once the direction of the transmission signal is chosen, it cannot be changed at a later time without manually adjusting the antenna.

Implementing PtP communication links in this conventional manner can be problematic because several different factors may cause the antennas to become misaligned, and thus interrupt the communication link. For example, wind acting on the antennas could result in a misalignment between the antennas, and exposure to the sun could deform the dish reflectors, which could also result in a misalignment between the antennas. Additionally, rain can degrade the communication link due to a rotation of the polarization of the antennas. Further, a misalignment could be caused by an error during the installing of the antennas, to provide some examples. In any event, the misalignment between the antennas may not be correctable without employing a highly-skilled technician to travel to the location of the affected antenna, and physically adjust the direction of the transmission signal to reestablish the communication link. However, this remedial method requires extensive time and resources, and thus can significantly increase both the capital expenditures as well as the operating expenditures associated with maintaining the communication link.

Thus, a need exists for a low cost antenna device for deployment in PtP wireless communication links, that allows for remote adjustments of a direction of the transmission signal such that the PtP communication link can be more efficiently maintained.

BRIEF DESCRIPTION OF THE DRAWINGS/FIGURES

Embodiments of the invention are described with reference to the accompanying drawings. In the drawings, like reference numbers indicate identical or functionally similar elements. Additionally, the left most digit(s) of a reference number identifies the drawing in which the reference number first appears.

Figure 1:
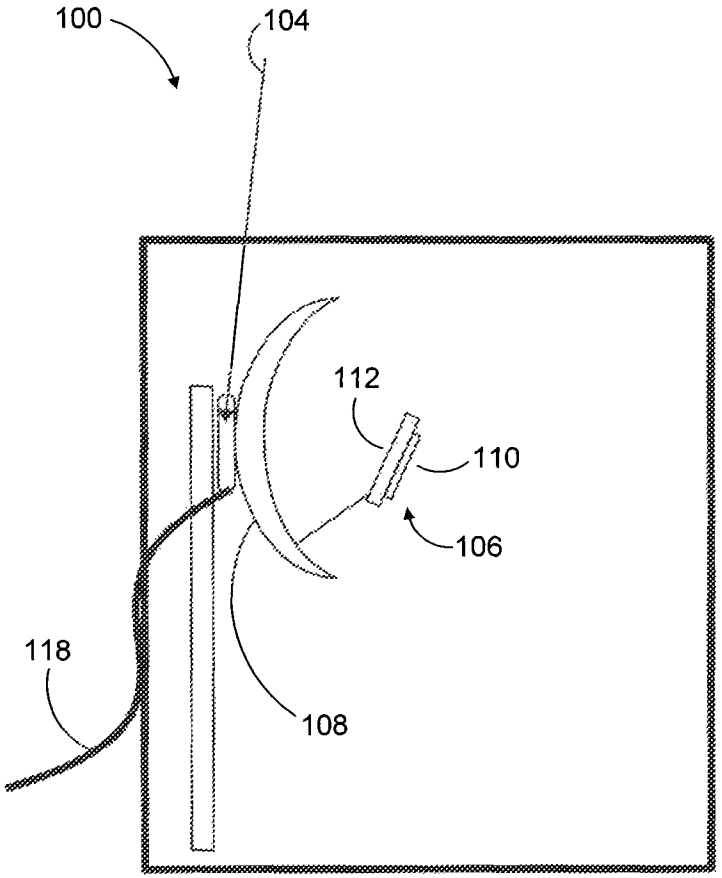
FIG. 1 is a schematic diagram of an antenna device according to an exemplary embodiment of the invention.

Embodiments will now be described with reference to the accompanying drawings. In the drawings, like reference numbers generally indicate identical, functionally similar, and/or structurally similar elements. The drawing in which an element first appears is indicated by the leftmost digit(s) in the reference number

DETAILED DESCRIPTION OF THE INVENTION

Implementation of conventional point-to-point (PtP) communication links can be problematic because several different factors can cause antennas to become misaligned, and thus interrupt the communication link. The misalignment between the antennas may not be correctable without employing a highly-skilled technician to travel to the location of the affected antenna, and physically adjust the direction of the transmission signal to reestablish the communication link. However, this remedial method requires extensive time and resources, and thus can significantly increase both the capital expenditures as well as the operating expenditures associated with maintaining the communication link. Thus, a need exists for a low cost antenna device for deployment in PtP wireless communication links, that allows for remote adjustments of a direction of the transmission signal such that the PtP communication link can be more efficiently maintained.

This Detailed Description refers to accompanying drawings that illustrate exemplary embodiments consistent with the invention. References in the Detailed Description to "one exemplary embodiment," "an exemplary embodiment," "an example exemplary embodiment," etc., indicate that the exemplary embodiment described may include a particular feature, structure, or characteristic, but every exemplary embodiment may not necessarily include the particular feature, structure, or characteristic. Moreover, such phrases are not necessarily referring to the same exemplary embodiment. Further, when a particular feature, structure, or characteristic is described in connection with an exemplary embodiment, it is within the knowledge of those skilled in the relevant art(s)

to affect such feature, structure, or characteristic in connection with other exemplary embodiments whether or not explicitly described.

The exemplary embodiments described herein are provided for illustrative purposes, and are not limiting. Other exemplary embodiments are possible, and modifications may be made to the exemplary embodiments within the spirit and scope of the invention. Therefore, the Detailed Description is not meant to limit the invention. Rather, the scope of the invention is defined only in accordance with the following claims and their equivalents.

Embodiments of the invention may be implemented in hardware, firmware, software, or any combination thereof. Embodiments of the invention may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact result from computing devices, processors, controllers, or other devices executing the firmware, software, routines, instructions, etc.

This Detailed Description of exemplary embodiments will so fully reveal the general nature of the invention that others can, by applying knowledge of those skilled in relevant art(s), readily modify and/or adapt for various applications such exemplary embodiments, without undue experimentation, without departing from the spirit and scope of the invention. Therefore, such adaptations and modifications are intended to be within the meaning and plurality of equivalents of the exemplary embodiments based upon the teaching and guidance presented herein. It is to be understood that the phraseology or terminology herein is for the purpose of description and not of limitation, such that the terminology or phraseology of the present specification is to be interpreted by those skilled in relevant art(s) in light of the teachings herein.

Although the invention is described in terms of wireless communication, those skilled in the relevant art(s) will recognize that the present invention may be applicable to other communications that use wired or other wireless communication methods without departing from the spirit and scope of the present invention.

An Exemplary Antenna Device

FIG. 1 is a schematic diagram of an antenna device according to an exemplary embodiment of the present disclosure. An antenna device 100 includes a beam steering element (e.g., a phased array feeder (PAF) assembly 106) and a directive element 108. In some embodiments, the antenna device 100 may also include a communication interface unit (e.g., an outdoor unit 104). The antenna device 100 is configured to be implemented in point-to-point (PtP) wireless communication links.

The antenna device 100 is an electrical device which converts electric currents into radio waves, and vice versa. The antenna device 100 may be implemented as a radio transmitter or a radio receiver, to provide some examples. During a transmission phase, the antenna device 100, acting as a radio transmitter, applies an oscillating radio frequency (RF) electric current to terminals located on the antenna device 100. The antenna device 100 then radiates energy from the RF electric current in the form of electromagnetic waves (e.g., radio waves). Conversely, during a reception phase, the antenna device 100 intercepts at least some of the energy of the electromagnetic waves to produce a voltage at the terminals, which is then applied to a receiver such that the voltage may be amplified.

The antenna device 100 may also include an arrangement of elements, which may be electrically connected through a transmission line to the radio receiver or radio transmitter, to provide an example. In an exemplary embodiment, the elements may include an arrangement of metallic conductors, to provide an example; however other elements, and other connection means, may be implemented without departing from the spirit and scope of the present disclosure.

The outdoor unit 104 performs a variety of functions on an incoming signal to allow a corresponding analog signal to be transmitted and/or received over the PtP wireless communication link. In particular, the outdoor unit 104 is configured to receive the incoming signal over a cable 118, and to perform a frequency conversion of the signal. In an embodiment, the outdoor unit 104 may be configured to receive a digital signal over an Ethernet cable. Additionally, the outdoor unit 104 may be configured to receive an analog signal over the cable 118 at an intermediate frequency (e.g., 140 MHz). Therefore, the cable 118 may be any type of interconnect that is capable of transmitting the incoming signal to the outdoor unit 104. For example, the cable 118 may be an Ethernet cable, a coaxial cable, a copper wire, or the like. The outdoor unit 104 may also be configured to convert an incoming low analog signal (e.g., having an intermediate frequency (IF)) to a high analog signal (e.g., having a radio frequency (RF)). In some embodiments, the outdoor unit 104 may be configured to convert an incoming digital signal to an analog signal, or an incoming analog signal to a digital signal. The following disclosure refers to the outdoor unit 104 receiving an incoming digital signal over an Ethernet cable; however, this is for illustrative purposes only, and does not limit this disclosure. In particular, as discussed above, the outdoor unit 104 may be configured to receive an analog signal over the cable 118. The outdoor unit 104 may then transmit the converted digital signal to the PAF assembly 106. In an exemplary embodiment, some of the functionalities that normally require the use of the outdoor unit 104 may be offloaded to other portions of the antenna device 100. For example, the outdoor unit 104 may only perform the IF conversion of the digital signal, while offloading the necessary RF conversion functionality to the PAF assembly 106, to provide an example; however the outdoor unit 104 may offload different functionalities to different portions of the antenna device 100 without departing from the spirit and scope of the present disclosure.

By offloading at least some functionalities, the outdoor unit 104 may be configured to have a smaller size than conventional outdoor units that are required to perform several different functions (e.g., IF conversions and RF conversions). Additionally, by offloading the RF conversion functionality to the PAF assembly 106, the outdoor unit 104 may have a much less complex design, and thus its installation may be much easier when compared to conventional outdoor units. Therefore, the outdoor unit 104 may also be less expensive than conventional outdoor units because there is no longer the need to purchase expensive components to perform the RF conversions. Additionally, the outdoor unit 104 may make heat dissipation implementation easier, which may further reduce costs. Consequently, the outdoor unit 104 may be relatively small in size, may have a simple design, and may be relatively inexpensive to implement within the antenna device 100.

The PAF assembly 106 is configured to perform various functions including those performed by the horn of a conventional antenna device. The PAF assembly 106 is configured to receive RF energy, to convert the RF energy, and to generate the RF energy for transmission. The PAF assembly 106 is also configured to alter its directionality so as to receive RF energy from the directive element 108 at a correct angle. The PAF assembly 106 may also be configured to transmit the RF energy to the directive element 108 at the correct angle. The PAF assembly 106 may include both an RF chip 110 and a phased array antenna 112. In an embodiment, the PAF assembly 106 may instead only include the phased array antenna 112, and the RF chip 110 may be implemented within other portions of the antenna device 100. The RF chip 110 is configured to perform the aforementioned RF conversion functionality. Additionally, the phased array antenna 112, or any other electronic element that is capable of radiating energy and having beam steering capabilities, may include multiple phased array elements in which the relative phases of the respective signals being fed into the phased array elements are varied in such a way that the effective radiation pattern of the PAF assembly 106 is reinforced in a desired direction and suppressed in undesired directions. Additionally, as used in this disclosure, the phased array elements represent a group of multiple active antennas coupled to a common source or load to produce a directive radiation pattern.

Further, in an exemplary embodiment, the PAF assembly 106 may include a Broadcom Corporation BCM20100, which supports the aforementioned RF conversion functionality as well as the electrical field generation capability. The PAF assembly 106 may also include two separate Broadcom Corporation BCM20100 chips, a first BCM20100 chip supporting the transmission functionality and a second BCM20100 chip supporting the reception functionality. The Broadcom Corporation BCM20100 is illustrative, and it is not the only PAF assembly capable of being used to implement the invention, and is not meant to limit this disclosure. In particular, any PAF assembly that functions as described herein may be used.

The directive element 108 is configured to focus the electrical field generated by the PAF assembly 106 into a narrow beam or other desired radiation pattern. In an exemplary embodiment, the narrow beam may be reduced to a range of approximately 0.4 degrees to approximately 1.2 degrees. In conventional antennas, such a narrow beam was typically difficult to use because such a narrow beam would have been highly sensitive to tower sway. However, as will become apparent to those skilled in the relevant art(s), the PAF assembly 106 is configured to counteract tower sway, and thus is configured to facilitate the use of the narrow beam. By producing such a narrow beam, the antenna device 100 may achieve high gains, up to approximately 50 dBi, without having to increase the number of phased array elements included within the antenna device 100. For example, only 16 phased array elements are needed to achieve gains of 38 dBi, 42 dBi and even a gain of 50 dBi. Thus, rather than having to increase the number of phased array element to achieve higher gains, only a size of the directive element 108 needs to be increased. In an exemplary embodiment, at the E Band frequencies (71-86 GHz) a gain of 38 dBi can be achieved with a directive element 108 having a size of approximately 20 cm, a gain of 42 dBi can be achieved with a directive element 108 having a size of approximately 30 cm, and a gain of 50 dBi can be achieved with a directive element 108 having a size of approximately 60 cm; to provide some examples.

In an exemplary embodiment, the narrow beam may allow for a longer link range between antenna devices, without having to implement relatively large directive elements. In particular, in conventional millimeter-wave PtP wireless communication links, only short link ranges were possible due to a high degree of signal fading. The short link ranges generally could not be longer than approximately 1.5 Km. However, the narrow beam, produced by the combination of the directive element 108 and the PAF assembly 106, allows for proper communication over longer links ranges because the narrow beam is less susceptible to fading. In particular, using the narrow beam, which is standard for mmWave frequency transmissions and for long hauls at lower frequencies, may be expensive because it typically required implementation on stable poles.

The PAF assembly 106 is configured to leverage benefits associated with phased arrays into the antenna device 100. For example, the PAF assembly 106 is configured to perform electrical beam steering to manipulate a directionality of the narrow beam. The PAF assembly 106 may alter the directionality of the narrow beam by up to approximately 5 degrees along each axis. Additionally, the PAF assembly 106 is configured to perform electrical polarization steering of the narrow beam. The PAF assembly 106 may adjust the electrical polarization steering by up to approximately 360 degrees. Additionally, the PAF assembly may have a cross polarization discrimination of at least 30 dB. In an exemplary embodiment, the PAF assembly 106 may perform the electrical beam steering and the electrical polarization steering to compensate for pointing errors of the antenna device 100, which may have resulted from an improper installation of the antenna device 100, Or may have resulted from a deformation of the directive element 108 due to exposure to the sun, to provide some examples. Further, the PAF assembly 106 may perform the electrical beam steering and the electrical polarization steering to compensate for rain degradations due to a rotation of the polarization of the antenna device 100. However, these exemplary benefits are for illustrative purposes only, and those skilled in the relevant art(s) will recognize that the PAF assembly 106 may be implemented to leverage other benefits, and may compensate for other errors associated with conventional antennas without departing from the spirit and scope of the present disclosure.

In an exemplary embodiment, the PAF assembly 106 may also perform all of the functionalities currently performed by the outdoor unit 104. In particular, the PAF assembly 106 may include the phased array antenna 112 as well as a die, which may include a media access controller (MAC), a physical layer (PHY) and an IF+RF conversion chip. Therefore, the PAF assembly 106 may perform both the IF and RF conversions. In particular, the antenna device 100 may not include the outdoor unit 104; instead the cable 118 may transmit the digital signal directly to the PAF assembly 106. Further, in an exemplary embodiment, the PAF assembly 106 may be any Broadcom Corporation chip or unit, which supports RF only or both the IF and RF conversion functionalities. In particular, any PAF assembly that functions as described herein may be used.

As discussed previously in this disclosure, the antenna device 100 is configured to be implemented in PtP wireless communication links. Specifically, the antenna device 100 may be configured to support PtP wireless communication links having frequencies in the range of approximately 7 GHz to approximately 42 GHz, or may be configured to support millimeter-wave PtP communication links having frequencies in the range of approximately 60 GHz to approximately 90 GHz, to provide some examples; however the antenna device 100 may be configured to support other frequencies without departing from the spirit and scope of the present disclosure. The antenna device 106 may be defined by a communications standard such as a dedicated ETSI and FCC standard (ETSI EN 302 217), to provide an example; however, other communication standards may also be possible without departing from the spirit and scope of the present disclosure.

An Exemplary Point-to-Point (PtP Wireless Communication Environment

Figure 2:
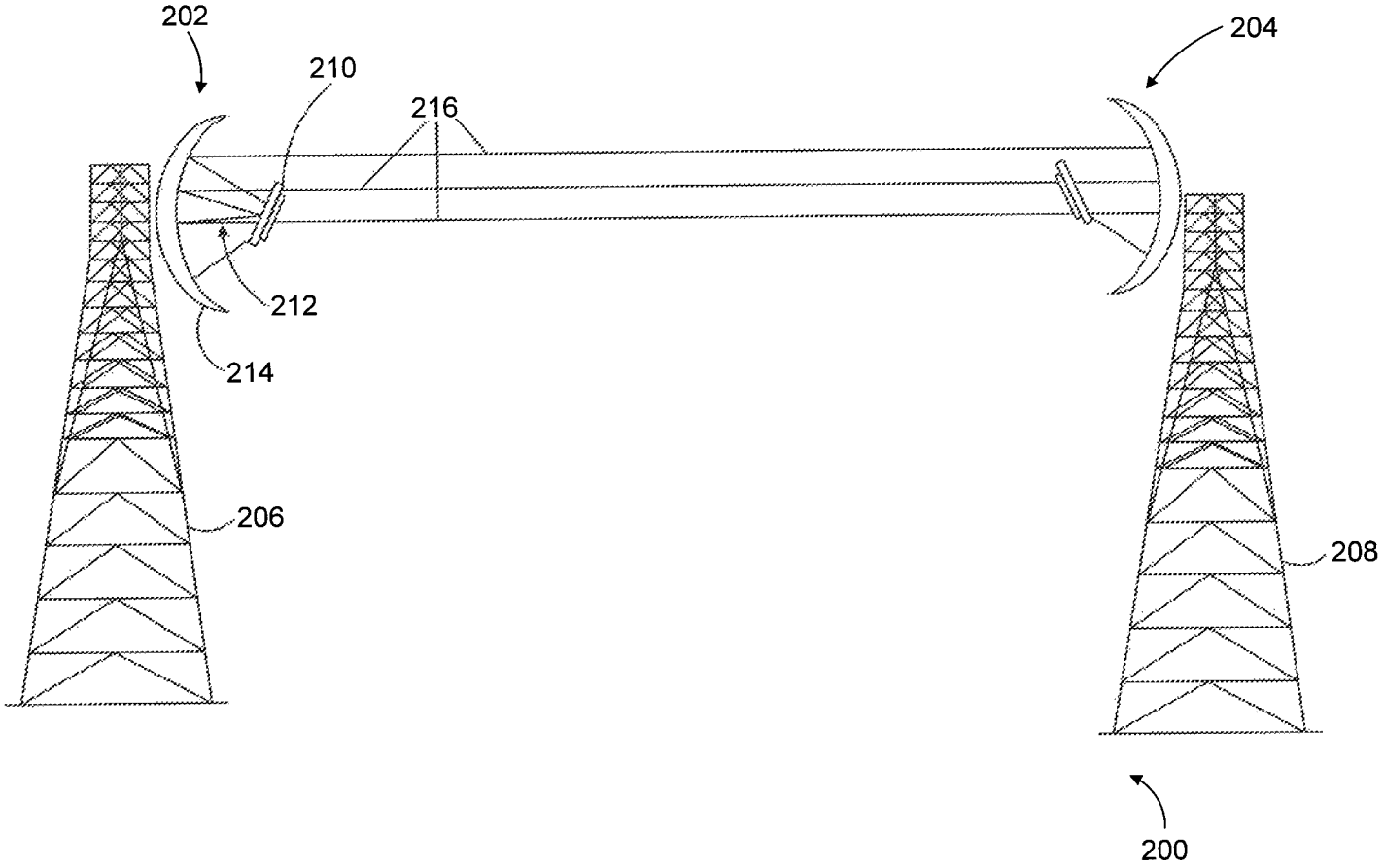
FIG. 2 is a schematic diagram of a point-to-point (PtP) wireless communication environment according to an exemplary embodiment of the invention.

FIG. 2 is a schematic diagram of a point-to-point (PtP) wireless communication environment according to an exemplary embodiment of the present disclosure.

A PtP wireless communication environment 200 provides for wireless communication of information, such as one or more commands and/or data, between a near end antenna device 202 and a far end antenna device 204. Both of the antenna devices 202 and 204 may represent an exemplary embodiment of the antenna device 100. The near end antenna device 202 is affixed to a first support structure 206 and the far end antenna device 204 is affixed to a second support structure 208. Although FIG. 2 depicts the first and second support structures 206 and 208 as being antenna towers, this is for illustrative purposes only, and is not meant to limit the disclosure in any way. Those skilled in the relevant art(s) will recognize that the first and second support structures 206 and 208 may be any structure capable of having an antenna mounted thereto.

The near end antenna device 202 includes a first PAF assembly 210, which may represent an exemplary embodiment of the PAF assembly 106. The first PAF assembly 210 is configured to generate an electrical field 212, and to direct the electrical field 212 towards a directive element 214. The directive element 214 is configured to focus the electrical field 212 into a narrow beam 216, and to direct the narrow beam 216 substantially towards the far end antenna device 204.

In an exemplary embodiment, the PtP wireless communication environment 200 is not subject to any external factors that could negatively affect the wireless link between the near end antenna device 202 and the far end antenna device 204. For example, there is no wind, rain, snow, sleet, over exposure from the sun, or other weather related condition present in the PtF wireless communication environment 200. There are also no other external factors such as mechanical vibrations present in the PtP wireless communication environment 200, to provide an example. However, these exemplary external factors are provided for illustrative purposes only, and are not meant to limit the disclosure in any way. In particular, any external or internal factors that could negatively affect a wireless communication link are not present in the PtP wireless communication environment 200. Additionally, both of the antenna devices 202 and 204 were installed properly, without any pointing errors. Therefore, in the PtP wireless communication environment 200, the narrow beam 216 transmitted from the near end antenna device 202 is properly received at the far end antenna device 204.

An Exemplary Point-to-Point (PtP) Wireless Communication Environment

Figure 3:
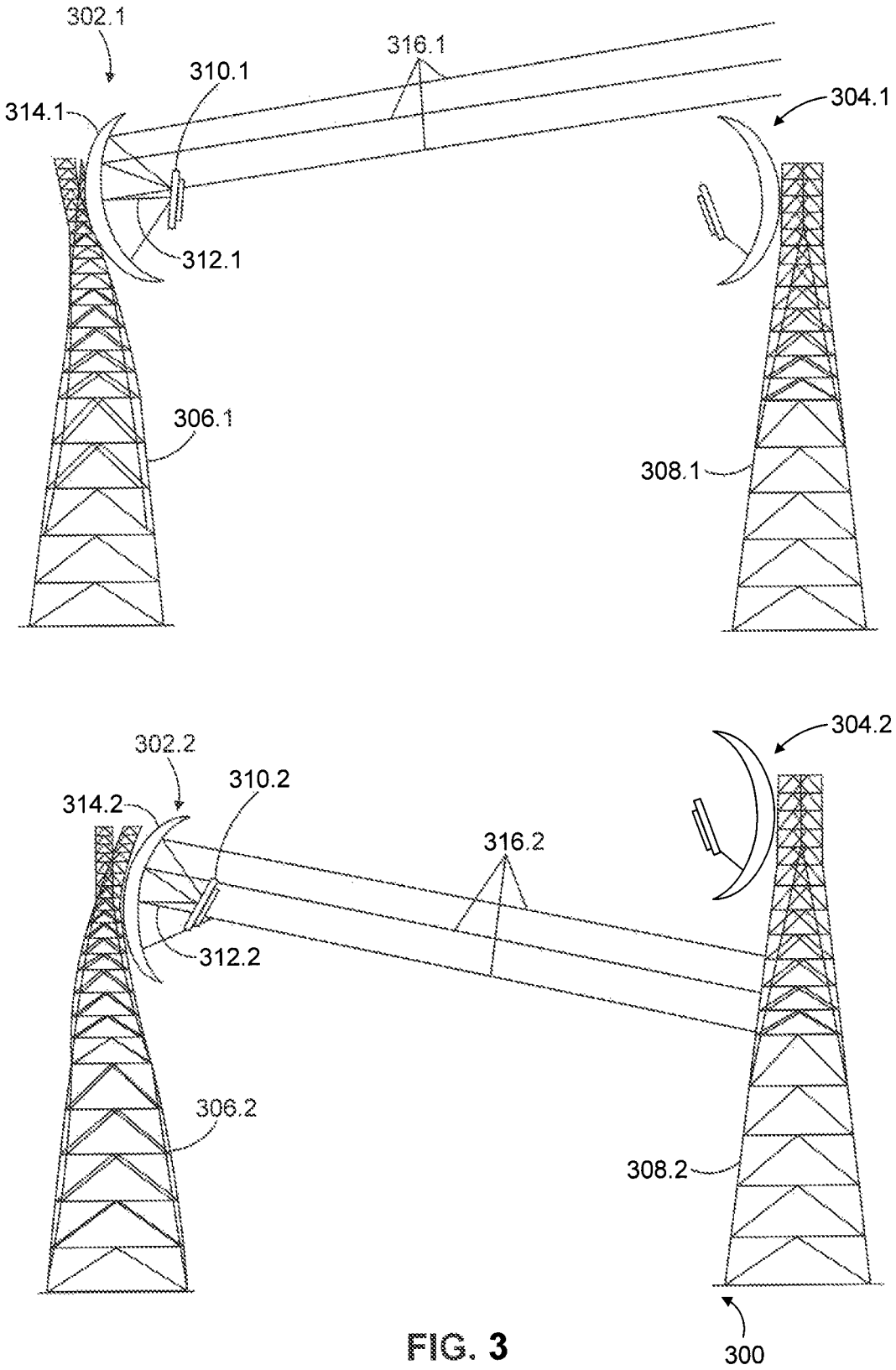
FIG. 3 is a schematic diagram of a PtP wireless communication environment that is impacted by external factors according to an exemplary embodiment of the present disclosure.

Referring also to FIG. 3, a schematic diagram of a PtP wireless communication environment that is affected by external factors according to an exemplary embodiment of the present disclosure is shown.

A PtP wireless communication environment 300 provides for wireless communication of information, such as one or more commands and/or data, between a pair of near end antenna devices 302.1 and 302.2, and a pair of far end antenna devices 304.1 and 304.2, respectively. Each of the antenna devices 302.1, 302.2, 304.1 and 304.2 may represent an exemplary embodiment of the antenna device 100. Additionally, the near end antenna devices 302.1 and 302.2 are affixed to first support structures 306.1 and 306.2, respectively, and the far end antenna devices are affixed to second support structures 308.1 and 308.2, respectively. Although FIG. 3 depicts the support structures 306.1, 306.2, 308.1 and 308.2 as being antenna towers, this is for illustrative purposes only, and is not meant to limit the disclosure in any way. Those skilled in the relevant art(s) will recognize that the support structures 306.1, 306.2, 308.1 and 308.2 may be any structure capable of having an antenna mounted thereto.

The near end antenna devices 302.1 and 302.2 include first PAF assemblies 310.1 and 310.2, respectively, which each may represent an exemplary embodiment of the PAF assembly 106. The first PAF assemblies 310.1 and 310.2 are configured to generate electrical fields 312.1 and 312.2, respectively, and to direct the electrical fields 312.1 and 312.2 towards directive elements 314.1 and 314.2, respectively. The directive elements 314.1 and 314.2 are configured to focus the electrical fields 312.1 and 312.2 into respective narrow beams 316.1 and 316.2, and to direct the narrow beams 316.1 and 316.2 substantially towards the far end antenna devices 304.1 and 304.2, respectively.

However, in contrast to the PtP wireless communication environment 200, communication environment 300 may be subject to external factors, such as wind, rain, snow, sleet, mechanical vibrations, or overexposure to the sun resulting in a deformation of the directive elements 314.1 and 314.2, to provide some examples; however, other external or internal factors may be present in the PtP wireless communication environment 300 without departing from the spirit and scope of the present disclosure. For illustrative purposes only, the functionality of the near end antenna devices 302.1 and 302.2 will be discussed with reference wind being present in the PtP wireless communication environment 300. However, an analogous process can be performed when the PtP wireless communication environment 300 is subject to other external or internal factors.

As discussed previously in this disclosure, the first support structures 306.1 and 306.2 may each represent an antenna tower. Thus, the first support structures 306.1 and 306.2 may sway in different directions, as a result of being exposed to the wind. In an exemplary embodiment, as a result of the wind, the first support structure 306.1 has swayed such that the near end antenna device 302.1 is now aimed in a substantially more upward direction than compared to its original position (shown in FIG. 2). Therefore, the near end antenna device 302.1 is no longer directing the narrow beam 316.1 at the far end antenna device 304.1. Consequently, the far end antenna device 304.1 may fail to properly receive the narrow beam 316.1.

Similarly, in an exemplary embodiment, the first support structure 306.2 may have swayed such that the near end antenna device 302.2 is now aimed in a substantially more downward direction than compared to its original position (shown in FIG. 2). Therefore, the near end antenna device 302.2 is no longer directing the narrow beam 316.2 at the far end antenna device 304.2, and thus the far end antenna device 304.2 may also fail to properly receive the narrow beam 316.2.

Multiple Exemplary Antenna Devices

Figure 4:
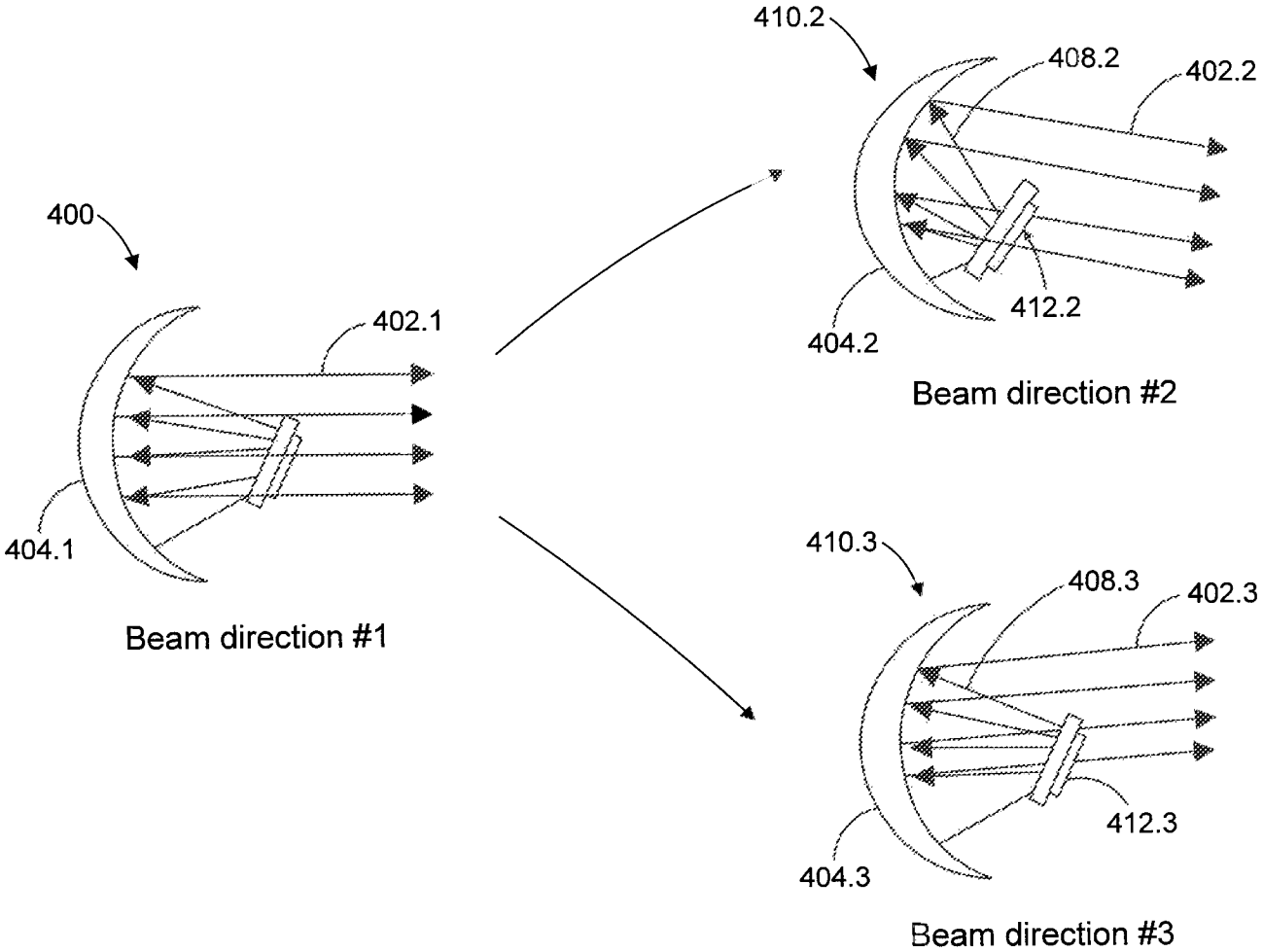
FIG. 4 is a schematic diagram of multiple antenna devices adjusting beam directions to correct a misalignment associated with each antenna device according to an exemplary embodiment of the invention.

Referring also to FIG. 4, a schematic diagram of multiple antenna devices adjusting beam directions to correct a misalignment associated with each antenna device according to an exemplary embodiment of the present disclosure is shown.

An antenna device 400 may represent an exemplary embodiment of the antenna device 202. In particular, the antenna device 400 may be configured such that a narrow beam 402.1 is directed in a substantially perpendicular direction away from a center of a directive element 404.1. However, as discussed previously in this disclosure, when the antenna device 400 is subjected to external factors, the directionality of the narrow beam 402.1 may be affected such that it may no longer be directed substantially towards the far end antenna devices 304.1 and 304.2 (not shown in FIG. 4). Thus, the narrow beam 402.1 may not be properly received at the far end antenna devices 304.1 and 304.2. Consequently, adjustments may need to be made to the antenna device 400 such that the narrow beam 402.1 is properly received by the far end antenna devices 304.1 and 304.2.

A corrected antenna device 410.2 may represent an exemplary embodiment of the near end antenna device 302.1, and may include a PAF assembly 412.2 and a directive element 404.2. The PAF assembly 412.2 may be configured to adjust its orientation or position such that it directs a generated electrical field 408.2 towards a higher portion of the directive element 404.2, thus resulting in a narrow beam 402.2 being directed in a more downward direction when compared to the narrow beam 402.1. Consequently, even when external factors causes the first support structure 306.1 (not shown in FIG. 4), and the affixed near end antenna device 302.1, to sway (see FIG. 3), by implementing the corrected antenna device 410.2, the narrow beam 402.2 may remain substantially directed at the far end antenna device 304.1.

Similarly, a corrected antenna device 410.3 may represent an exemplary embodiment of the near end antenna device 302.2, and may include a PAF assembly 412.3 and a directive element 404.3. In particular, the PAF assembly 412.3 may adjust its orientation or position such that it directs a generated electrical field 408.3 towards a lower portion of the directive element 404.3, thus resulting in a narrow beam 402.3 being directed in a more upward direction when compared to the narrow beam 402.1. Consequently, even when external factors causes the first support structure 306.2 (not shown in FIG. 4), and the affixed near end antenna device 302.2, to sway (see FIG. 3), by implementing the corrected antenna device 410.3, the narrow beam 402.3 may remain substantially directed at the far end antenna device 304.2.

In an exemplary embodiment, the orientation and position of the PAF assemblies 412.2 and 412.3, as well as the resulting directionality of the narrow beams 402.2 and 402.3 are related to the focal point of the directive elements 404.2 and 404.3, respectively.

The adjustments of the orientations and/or positions of the PAF assemblies 412.2 and 412.3 may facilitate the aforementioned electrical beam steering to manipulate the directionality of the narrow beams 402.2 and 402.3. Additionally, although not depicted in FIG. 4, the adjustments of the orientations and/or positions of the PAF assemblies 412.2 and 412.3 may also facilitate the electrical polarization steering of the narrow beams 402.2 and 402.3. As discussed previously in this disclosure, the PAF assemblies 412.2 and 412.3 may alter the directionality of the narrow beams 402.2 and 402.3 by up to approximately 5 degrees along each axis, and the PAF assemblies 412.2 and 412.3 may adjust the electrical polarization steering by up to approximately 360 degrees. Therefore, the PAF assemblies 412.2 and 412.3 may perform the electrical beam steering and the electrical polarization steering to compensate for various installation related errors, as well as various external and internal factors, to provide some examples.

In an exemplary embodiment, by configuring the PAF assemblies 412.2 and 412.3 to perform the electrical beam steering and the electrical polarization steering, the corrected antenna devices 410.2 and 410.3 may be installed using rough mechanical pointing. In particular, since the PAF assemblies 412.2 and 412.3 can adjust the directionality of the narrow beams 412.2 and 412.3, the corrected antenna devices 410.2 and 410.3 do not have to be installed with exact precision. Instead, the corrected antenna devices 410.2 and 410.3 only need to be pointed substantially towards the far end antenna devices 304.1 and 304.2, and the fine tuning may be performed electronically, at a remote location. The remote electrical fine tuning may allow for shorter installation times, to provide an example. Additionally, the electrical fine tuning may be performed by systematically eliminating possible directionalities, using a feedback loop, or using an algorithm, to provide some examples. Further, the electrical fine tuning may be performed based on information collected from a variety of sensors located on or near the corrected antenna devices 410.2 and 410.3. In an exemplary embodiment, the sensors may collect information relating to wind speed and vibration intensity, as well as a current directionality and polarization of the narrow beams 402.2 and 402.3, to provide some examples; however, the sensors may collect other information without departing from the spirit and scope of the present disclosure. The electrical fine tuning allows the corrected antenna devices 410.2 and 410.3 to automatically track the far end antenna devices 304.1 and 304.2. Further aspects and advantages of the electrical fine tuning and the electrical steering will be apparent to those skilled in the relevant art(s).

In an exemplary embodiment, the installation of the corrected antenna devices 410.2 and 410.3 may be performed by a person having a lower level of technical skill than was previously required for the installation of conventional antennas, because only a rough mechanical pointing of the corrected antenna devices 410.2 and 410.3 is needed. Consequently, this may reduce the capital expenditures and operating expenditures associated with the installation of the corrected antenna devices 410.2 and 410.3.

Additionally, the adjustable PAF assemblies 412.2 and 412.3 allow for the corrected antenna devices 410.2 and 410.3 to perform far end tracking of the far end antenna devices 304.1 and 304.2. In an exemplary embodiment, far end tracking fixes mispointing of the near end antenna devices 302.1 and 302.2 such that the wireless link can be maintained. The ability to fix mispointing also reduces the maintenance costs associated with the operation of the antenna devices 302.1, 302.2, 304.1 and 304.2 because it alleviates the need to have a mechanical engineer travel to the location of the antenna devices and physically adjust their directionalities. Further, far end tracking allows the corrected antenna devices 410.2 and 410.3 to compensate for the tower sway associated with the first support structures 306.1 and 306.2. Therefore, the corrected antenna devices 410.2 and 410.3 may be mounted to other support structures, which were previously too unstable to support the corrected antenna devices 410.2 and 410.3. For example, the corrected antenna devices 410.2 and 410.3 may be mounted to lamp posts, telephone poles, sign posts and traditional PtP towers; however, other support structures are possible without departing from the spirit and scope of the present invention. By compensating for tower sway, the corrected antenna devices 410.2 and 410.3 may also be installed at higher points on the antenna towers than were previously possible.

Figure 5:
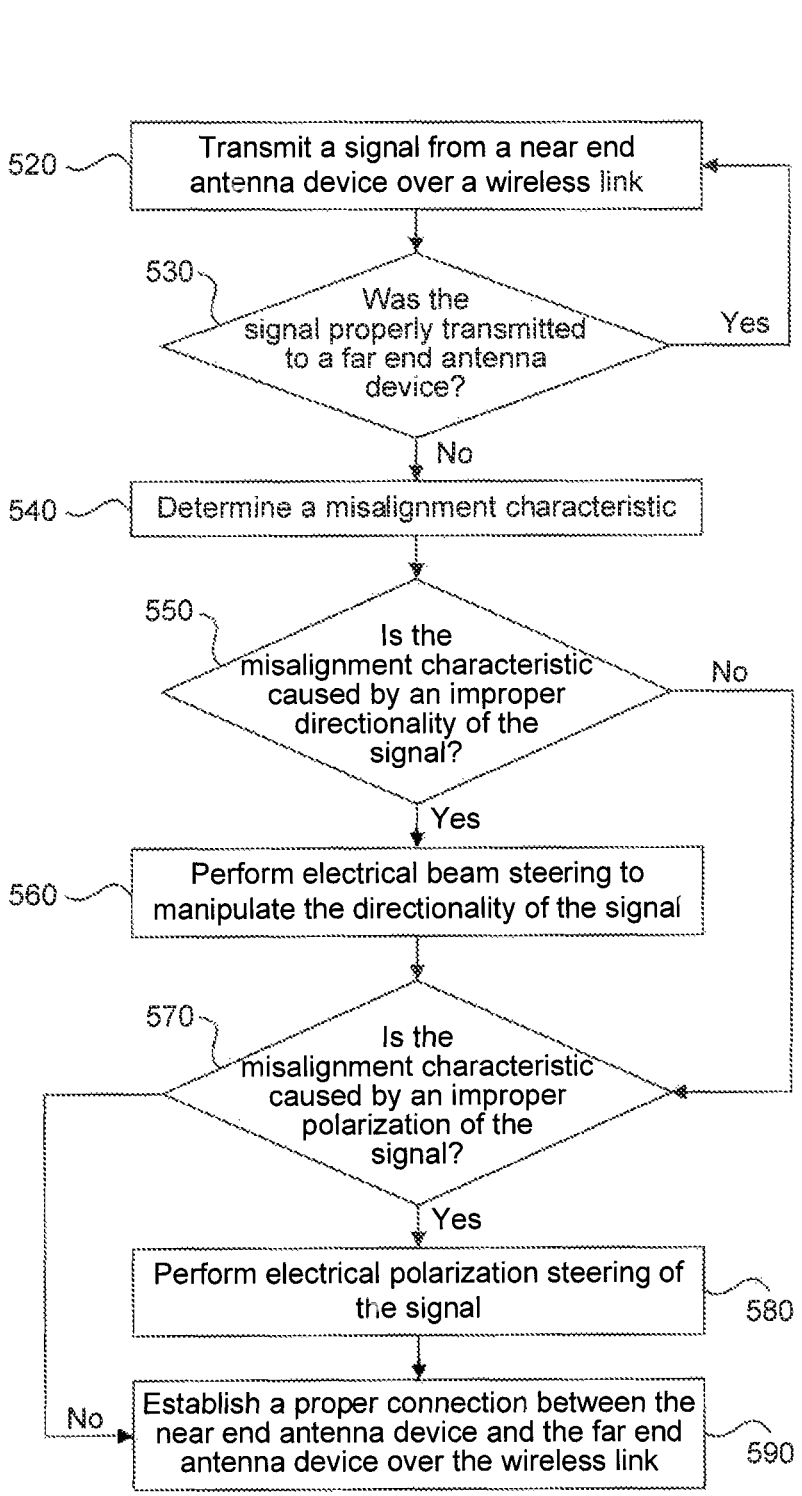
FIG. 5 is a flowchart of exemplary operation steps of maintaining a PtP wireless communication link according to an exemplary embodiment of the invention.

An Exemplary Method of Maintaining a Point-to-Point (PtP) Wireless Communication Link FIG. 5 is a flowchart of exemplary operation steps of maintaining a PtP wireless communication link according to an exemplary embodiment of the invention. The disclosure is not limited to this operational description. Rather, it will be apparent to persons skilled in the relevant art(s) from the teachings herein that other operational control flows are within the scope and spirit of the present disclosure. The following discussion describes the steps in FIG. 5.

A method 500 begins at step 520, where a signal is transmitted from a near end antenna device over a wireless link. The signal may represent an exemplary embodiment of the narrow beam 114, and the near end antenna device may represent and exemplary embodiment of the antenna device 100. The method then proceeds to step 530. In step 530, a determination is made as to whether the signal was properly transmitted to a far end antenna device. If the determination is yes, that the signal was properly transmitted, then the method returns to step 520 so that another signal can be transmitted. If the determination at step 530 is no, that the signal was improperly transmitted, then the method proceeds to step 540. In step 540, a misalignment characteristic is determined. The misalignment characteristic may represent a degree that the directionality of the near end antenna device differs from the directionality of the far end antenna device, or it may represent a degree of that the polarization of the near end antenna device differs from the polarization of the far end antenna device.

The method then proceeds to step 550. In step 550, a second determination is made, whether the misalignment characteristic is caused by an improper directionality of the signal. If the determination is yes, then the method proceeds to step 560, where electrical beam steering is performed to manipulate the directionality of the signal. In particular, the directionality of the signal is electrically adjusted, at a remote location, until the signal is substantially directed at the far end antenna device. The method then proceeds to step 570. Additionally, if the determination at step 550 is no, that the misalignment characteristic is not caused by an improper directionality, then the method also proceeds to step 570.

In step 570, a third determination is made, whether the misalignment characteristic is caused by an improper polarization of the signal. If the determination is yes, then the method proceeds to step 580, where electrical polarization steering is performed on the signal. In particular, the polarization of the signal is electrically adjusted, at a remote location, until the signal is properly transmitted to the far end antenna device. The method then proceeds to step 590. If the determination at step 570 is no, that the misalignment characteristic is not caused by an improper polarization of the signal, then the method also proceeds to step 590.

In step 590, a proper connection between the near end antenna device and the far end antenna device is established over the wireless link. In particular, the proper connection is established as a result of the electrical beam steering and the electrical polarization steering performed at the near end antenna device, which are both facilitated by the implementation of the PAF assembly 106 (not shown in FIG. 5). Thus, even when subjected to the aforementioned external or internal factors, the PtP wireless communication link between the near end antenna and the far end antenna can be maintained at a low cost.

CONCLUSION

It is intended that the Detailed Description section of this patent document, and not the Abstract section, is intended to be used to interpret the claims. The Abstract section may set forth one or more, but not all exemplary embodiments, of the invention, and thus, are not intended to limit the invention and the appended claims in any way.

The invention has been described above with the aid of functional building blocks illustrating the implementation of specified functions and relationships thereof The boundaries of these functional building blocks have been arbitrarily defined herein for the convenience of the description. Alternate boundaries may be defined so long as the specified functions and relationships thereof are appropriately performed.

It will be apparent to those skilled in the relevant art(s) that various changes in form and detail can be made therein without departing from the spirit and scope of the invention. Thus the invention should not be limited by any of the above-described exemplary embodiments, but should be defined only in accordance with the following claims and their equivalents.

What is claimed is:

1. An antenna device for implementation in point-to-point communication links, comprising:

a directive element configured to focus an electrical field into a narrow antenna beam, wherein the narrow antenna beam is directed substantially towards a second antenna device;

a beam steering element configured to generate the electrical field and to automatically track the second antenna device to account for a mispointing of the antenna device; and a communication interface unit configured to perform operations on a transmit signal and a received signal.

2. The antenna device of claim 1, wherein the beam steering element includes a phased array antenna.

3. The antenna device of claim 2, wherein the beam steering element is configured to perform electrical beam steering to manipulate a directionality of the narrow antenna beam, wherein the directionality of the narrow antenna beam is manipulated by approximately 5 degrees along each axis, and wherein the directionality of the narrow beam is manipulated from a remote location.

4. The antenna device of claim 2, wherein the beam steering element is configured to perform electrical polarization steering of the narrow antenna beam, wherein a polarization of the narrow beam is adjustable by up to approximately 360 degrees, and wherein the polarization is adjusted from a remote location.

5. The antenna device of claim 2, wherein the beam steering element includes an RF chip.

6. The antenna device of claim 2, wherein the communication interface unit is configured to receive the transmit signal over a cable, to perform an intermediate frequency conversion of the transmit signal, and to offload a radio frequency conversion functionality to the beam steering element.

7. The antenna device of claim 1, wherein the beam steering element is configured to increase a gain of the antenna device while maintaining a constant number of phased array elements included within the beam steering element.

8. The antenna device of claim 1, wherein the antenna device is configured to be implemented in millimeter-wave point-to-point communication links having frequencies in the range of approximately 60 GHz to approximately 90 GHz.

9. The antenna device of claim 1, wherein the antenna device is configured to be implemented in the point-to-point communication links having frequencies in the range of approximately 7 GHz to approximately 42 GHz.

10. The antenna device of claim 1, wherein the mispointing of the antenna device is detected using a feedback loop or a sensor implemented at the antenna device.

11. A point-to-point communication system, comprising:

a near end antenna device configured to transmit a narrow antenna beam over a wireless link; and a far end antenna device configured to receive the narrow antenna beam over the wireless link, wherein the near end antenna device includes:

a directive element configured to focus an electrical field into the narrow antenna beam;

a beam steering element configured to generate the electrical field and to automatically track the far end antenna such that the narrow antenna beam is maintained in a direction substantially towards the far end antenna device in an event of a mispointing of the near end antenna device; and a communication interface unit configured to perform operations on a transmitted signal and a received signal.

12. The point-to-point communication system of claim 11, wherein the beam steering element includes a phased array antenna.

13. The point-to-point communication system of claim 12, wherein the beam steering element is configured to perform electrical beam steering to manipulate a directionality of the narrow antenna beam, wherein the directionality of the narrow antenna beam is manipulated by approximately 5 degrees along each axis, and wherein the directionality of the narrow antenna beam is manipulated from a remote location.

14. The point-to-point communication system of claim 12, wherein the beam steering element is configured to perform electrical polarization steering of the narrow antenna beam, wherein a polarization of the narrow antenna beam is adjustable by up to approximately 360 degrees, and wherein the polarization is adjusted from a remote location.

15. The point-to-point communication system of claim 12, wherein the near end antenna device is configured to receive the narrow antenna beam over the wireless link, wherein the far end antenna device is configured to transmit the narrow antenna beam over the wireless link, and wherein the far end antenna device includes a second beam steering element.

16. The point-to-point communication system of claim 11, wherein the beam steering element is configured to increase a gain of the near end antenna device while maintaining a constant number of phased array elements included within the beam steering element.

17. The point-to-point communication system of claim 16, wherein the beam steering element includes an RF chip.

18. The point-to-point communication system of claim 11, wherein the mispointing of the near end antenna device is caused by one or more environmental factors, one or more internal factors, or one or more errors during installation of either the near end antenna device or the far end antenna device.

19. The point-to-point communication system of claim 11, wherein the mispointing of the near end antenna device is detected using a feedback loop or a sensor implemented at the near end antenna device.

20. A method for maintaining a point-to-point communication link, comprising:

transmitting a signal from a near end antenna device over a wireless link;

concluding whether the signal was properly transmitted to a far end antenna device;

determining a misalignment characteristic when it is concluded that the signal was improperly transmitted to the far end antenna device;

adjusting the near end antenna device to correct the misalignment characteristic, wherein the adjusting includes electrically altering, from a remote location, a beam steering element included within the near end antenna device; and establishing a proper connection between the near end antenna device and the far end antenna device over the wireless link.

21. The method of claim 20, wherein the electrically altering the beam steering element includes performing electrical beam steering to manipulate a directionality of the signal, wherein the directionality of the signal is manipulated by approximately 5 degrees along each axis.

22. The method of claim 20, wherein the electrically altering the beam steering element includes performing electrical polarization steering of the signal, wherein a polarization of the signal is adjustable by up to approximately 360 degrees.

23. The method of claim 20, wherein the misalignment characteristic is caused by an environmental factor, an internal factor, or an error during installation of either the near end antenna device or the far end antenna device.

24. The method of claim 20, wherein the misalignment characteristic is determined using a feedback loop or a sensor implemented at the near end antenna device.

* * * * *